US007690140B2

(12) United States Patent
Ho et al.

(10) Patent No.: US 7,690,140 B2
(45) Date of Patent: Apr. 6, 2010

(54) IRONING SHOE

(75) Inventors: Kat Tong Ho, Singapore (SG); Pieter Johannes Werkman, Drachten (NL); Li Chen Tan, Singapore (SG); Saskia Ingeborg Kranenberg, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/279,878

(22) PCT Filed: Feb. 22, 2007

(86) PCT No.: PCT/IB2007/050562

§ 371 (c)(1),
(2), (4) Date: Aug. 19, 2008

(87) PCT Pub. No.: WO2007/096825

PCT Pub. Date: Aug. 30, 2007

(65) Prior Publication Data

US 2008/0313936 A1 Dec. 25, 2008

(30) Foreign Application Priority Data

Feb. 23, 2006 (EP) ..... 06110335

(51) Int. Cl.
*D06F 75/38* (2006.01)
*D06F 79/00* (2006.01)

(52) U.S. Cl. ..... 38/97

(58) Field of Classification Search ..... 38/80, 38/81, 93, 97, 77.83
See application file for complete search history.

(56) References Cited

U.S. PATENT DOCUMENTS

| | | | | |
|---|---|---|---|---|
| 3,257,746 | A | 6/1966 | Cohen | |
| 3,318,029 | A | 5/1967 | Jacobson | |
| 3,404,471 | A * | 10/1968 | Wilsker et al. | 38/97 |
| 3,905,138 | A * | 9/1975 | Abolafia | 38/97 |
| 5,804,791 | A * | 9/1998 | Gelus | 219/245 |
| 5,937,552 | A | 8/1999 | Hall | |
| 6,122,849 | A * | 9/2000 | Kida et al. | 38/93 |
| 6,151,815 | A * | 11/2000 | Cuzel et al. | 38/77.8 |
| 6,539,651 | B1 | 4/2003 | Rius et al. | |
| 6,581,309 | B1 | 6/2003 | Conforti | |

FOREIGN PATENT DOCUMENTS

| | | | |
|---|---|---|---|
| CH | 567142 | A5 | 9/1975 |
| DE | 2612848 | B1 | 5/1977 |
| EP | 1031655 | A1 | 8/2000 |

* cited by examiner

*Primary Examiner*—Ismael Izaguirre

(57) ABSTRACT

An ironing shoe comprising a laminate having at least one laminate opening and a laminate periphery similar to a sole periphery of a sole plate of an iron, the sole plate having a sole plate surface, the laminate comprising a heat insulating layer having a sole contact surface for making contact with the sole plate surface of the iron and a heat transfer layer having a garment contact surface for ironing. The shoe can comprise a fastening means in the form of a protrusion, the protrusion and the heat insulating layer being made of the same material. The heat insulating layer can have an edge rib alone at least a part of its periphery to reduce the leakage of steam.

17 Claims, 5 Drawing Sheets

Figure 1A:
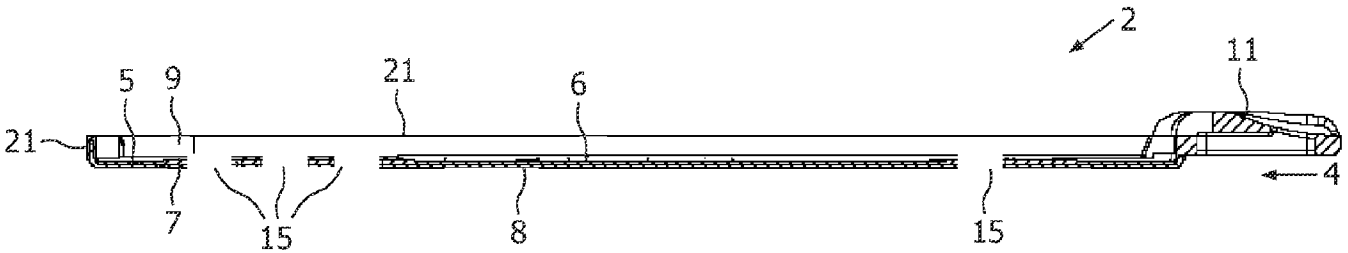

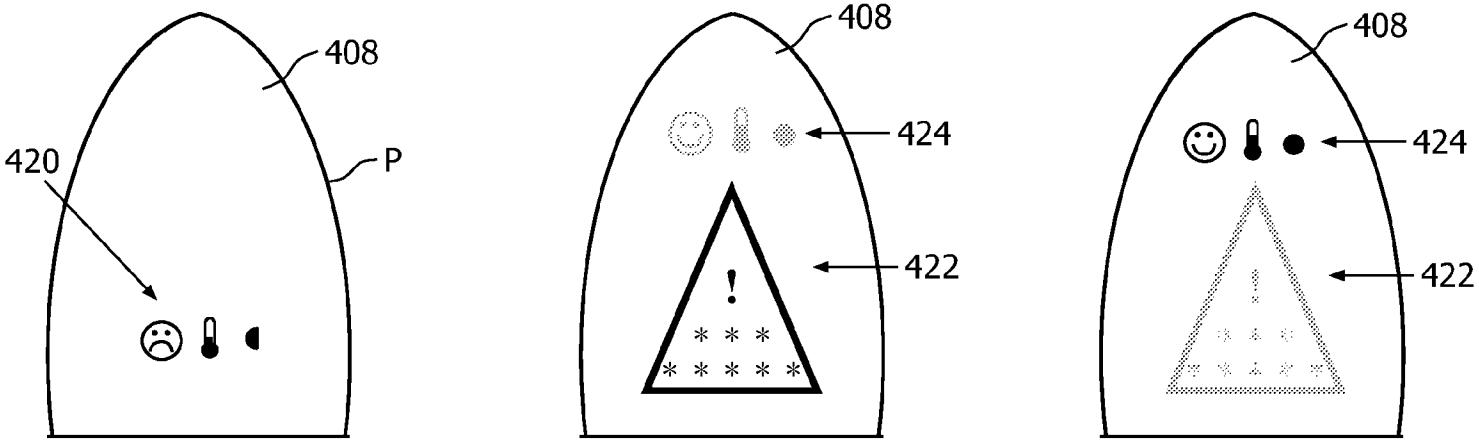
FIG. 5a
FIG. 5b
FIG. 5c
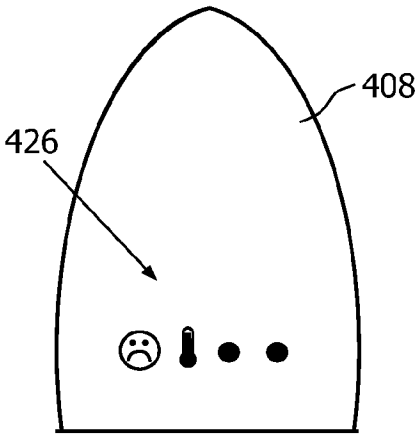
FIG. 5d
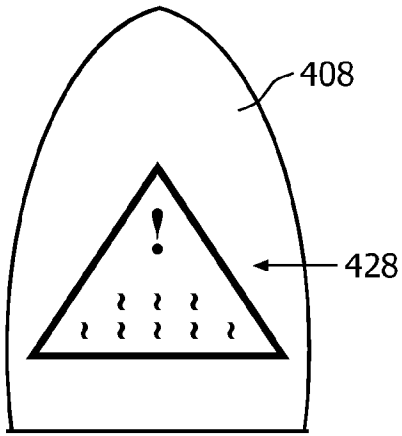
FIG. 5e

IRONING SHOE

The invention relates to an ironing shoe. The invention also relates to a garment care system and a method of manufacturing an ironing shoe.

An ironing shoe is known in practice. The shoe, if mounted to a steam ironing device, is usually used to reduce the temperature of the surface in contact with the garment.

Steam ironing devices are well-known in practice. A steam ironing device may be a steam iron or a so-called boiler ironing system. The boiler ironing system comprises a steam iron, having a sole plate with a sole plate surface and a boiler for heating water which is arranged separately from the steam iron, wherein the water tank is attached to a stand comprising the boiler. In many cases, the water tank is removably arranged, so that a user of the device comprising the water tank is capable of filling the water tank from a tap or the like without having to move the entire device.

In a conventional steam iron, steam is generated by a steam generating means, which comprises a water reservoir and a steam chamber. Usually a water-dosing pump is provided to pump the water from the water reservoir to the steam chamber (as drops rather than a large flow of water). The water may be pumped via a hose under command of a pump signal from an electric control device. The rate at which water is supplied dictates the amount of steam being produced, and the amount of steam is sufficiently low that the temperature of the sole plate is not significantly affected.

Instead of a pumped system, water can be dosed to the steam chamber under gravity.

The steam chamber is typically heated by the sole plate, but an auxiliary heating element may be provided instead.

The steam from the steam chamber reaches the steam outlet opening or openings provided in the sole plate of the iron.

The sole plate of the iron is usually heated by an electric heating element. The temperature of the sole plate is kept at a desired value by means of a thermostat and a temperature dial. The number of dots on the temperature dial indicates the temperature of the sole plate surface of the iron:

1 dot, on average 110° C., this is the Low setting on most irons, 2 dots, on average 150° C., this is the Medium setting on most irons, 3 dots, on average 200° C., this is the High setting on most irons.

Delicate fabrics like e.g. silk, velvet cannot be exposed to the 2-dot or 3-dot temperature settings, because it would damage the fabric. Ironing delicate fabrics is therefore usually done using the 1-dot low temperature setting of the iron. This may not give the desired ironing result. A user may therefore desire to use steam. The steam produced by the steam ironing system serves to dampen the fabric to be ironed. The application of moisture to a garment during ironing makes the ironing process easier, and reduces the time involved.

For steam ironing, the 2-dot or 3-dot temperature setting is recommended, otherwise there is a risk of dripping or spitting of water. Because this 2-dot or 3-dot temperature setting is usually too high for ironing delicate fabrics, an ironing shoe may be used. The ironing shoe may be used as a detachable accessory to the iron. If the user mounts the shoe to the sole plate of the iron, the ironing shoe acts as a thermal barrier that reduces the temperature of the surface in contact with the garment. This way, the steam iron may be operated at a 2 or 3-dot temperature setting, while the temperature of the surface in contact with the garment is reduced. This way, a delicate garment may be ironed using steam without the risk of dripping or spitting of water due to too low a temperature of the iron.

U.S. Pat. No. 3,318,029 describes a method of fabricating an accessory shoe for a hand iron. The shoe obtained via the method described has a laminated construction comprising an outer plastic sheet and an inner metal reinforcement sheet. While mounting such a shoe to and unmounting it from the sole plate of the iron, there is a risk that the metal reinforcement sheet damages the sole plate, in particular the sole plate surface.

It is an object of the invention to provide an ironing shoe where the risk of damaging the sole plate of the iron during mounting or unmounting of the iron is reduced.

This object is achieved by the ironing shoe as claimed in claim 1.

After mounting the ironing shoe according to the invention to the iron, the sole contact surface of the heat insulating layer is in contact with the sole plate surface of the iron. The sole contact surface and the garment contact surface of the heat transfer layer are turned away from each other. During mounting and un-mounting of the shoe, as well as during ironing, the garment contact surface of the heat transfer layer is not in direct contact with the sole plate surface. This way, the heat transfer layer does not scratch the sole plate, in particular the surface of the sole plate, during mounting or unmounting of the ironing shoe, and the risk of damaging the sole plate of the iron during mounting the shoe to the iron or unmounting the shoe from the iron is reduced. This way, the object of the invention is achieved.

The ironing shoe according to the invention has a limited number of parts; this simplifies the assembly and/or production process of the shoe.

In an embodiment of the ironing shoe according to the invention, the heat transfer layer is a reinforcement layer that provides firmness to the laminate. As a result, the shoe has a certain sturdiness which may help in mounting and unmounting the ironing shoe. A firm laminate facilitates positioning of the shoe with respect to the iron or vice versa. Usually the iron has a narrow front, referred to as tip, and a broader back portion, referred to as heel end, and the ironing shoe has a corresponding tip and a corresponding heel end. While holding the iron in one hand and the shoe in the other hand, the user may place the tip of the shoe at the tip of the iron. Due to the stiffness of the laminate the user can simply tilt the heel end of the shoe towards the heel end of the iron and thus bring the sole contact surface of the shoe into contact with the sole plate surface of the iron.

In an embodiment of the ironing shoe according to the invention, the material of the heat transfer layer may comprise a metal such as stainless steel or aluminum. In a practical embodiment, the heat transfer layer is made from aluminum. Aluminum is preferred because of its non-rusting and high thermal transfer properties. When aluminum is mentioned in this application, both aluminum and aluminum alloys are meant. Suitable choices are for example Aluminum 1100, Aluminum alloy 5052 or Aluminum alloy 5754.

The garment contact surface of the ironing shoe according to the invention may be coated to ensure smooth gliding and improve scratch resistance. Such a coating may comprise a sol-gel layer, a polytetrafluoroethylene (PTFE) layer or a polyether ether ketone (PEEK) layer. The coating may improve the aesthetics of the garment contact surface and as a result the aesthetics of the ironing shoe.

In an embodiment of the ironing shoe according to the invention, the material of the heat insulating layer is preferably a high-temperature resistance polymer. This way, a temperature drop between the iron sole plate surface and the garment contact surface is obtained. Suitable polymers may be selected from a group comprising silicone rubber, polyether ether ketone (PEEK), polyimide (PI), polyphenylene sulfide (PPS), polyamide-imide (PAI) or three-dimensional inorganic polymers such as methyl trimethoxy silane-based materials. A suitable example of the latter is Silres 610® from Wacker which is a pre-polymerised methyl trimethoxy silane.

Silres® 610 is a methyl group containing silicone resin that may be used as a binder for heat resistant paints. It furthermore has good adhesion properties to aluminum. It can thus be directly used on aluminum without an additional adhesion layer. This way, the number of layers in the laminate is limited to two.

Another suitable material for the heat insulating layer is Elastosil® R401 from Wacker Silicones. Elastosil® R401 is a solid silicone rubber that is cured by organic peroxide crosslinking. This material would require the use of an adhesive between the heat-insulating layer and the heat transfer layer.

In case the adhesion between the heat insulating layer and the heat transfer layer is not sufficient, an adhesion layer such as an epoxy resin may be applied between the heat insulating layer and the heat transfer layer. An example of a suitable epoxy adhesive is Scotch-Weld™ Epoxy Adhesive DP-125 by 3M, which comprises aliphatic polymer diamine, sulfonic acid salt and amorphous silica.

An alternative adhesive may be Dow Corning® S 2260 Prime Coat; this is a solvent-based silicone comprising light aliphatic petroleum solvent naphtha, vinyltrimethoxysilane, tetra propyl orthosilicate, tetra (2-methoxyethoxy) silane and tetrabutyl titanate.

After mounting the ironing shoe according to the invention to the iron, the sole contact surface of the heat insulating layer is in contact with the sole plate surface of the iron. In case an adhesive is used to adhere the heat insulating layer and the heat transfer layer to one another, during use the adhesive will be exposed to a lower temperature than the temperature of the contact surface of the heat insulating layer. This is due to the heat insulating effect of the heat insulating layer. Therefore, the adhesive in the ironing shoe according to the invention has to be able to withstand a temperature which is lower than the temperature of the sole plate surface. The adhesive may have a lower temperature resistance as compared to the prior art solution where a polymer layer is bonded on the side of the shoe facing the garment. This provides more flexibility in selecting the adhesive; the adhesive may be selected from a wider range of adhesives.

In order to mount the ironing shoe to the iron, preferably a fastening means is provided. The fastening means prevents the shoe from disengaging from the sole plate of the iron during use. The fastening means may comprise a protrusion fixed to the ironing shoe cooperating with a receiving means such as a recess in the sole plate of the iron or vice versa. A skilled person may select any suitable fastening means.

In an embodiment of the ironing shoe according to the invention, the protrusion is located at the periphery of the laminate and is integrated with the heat insulating layer. In a further embodiment of the ironing shoe according to the invention, the fastening means comprise the protrusion and at least one flank portion.

In a practical embodiment, the heat insulating layer and the fastening means form one piece made from the same polymer. The heat transfer layer is adhered to this piece. Suitable polymers may be selected from a group comprising silicone rubber, polyether ether ketone (PEEK), polyimide (PI), polyphenylene sulfide (PPS), polyamide-imide (PAI). During mounting and un-mounting of this embodiment, only polymer material is in contact with the sole plate; this way the risk of scratches caused by the heat transfer layer, e.g. aluminium, is further reduced.

In a practical embodiment of the ironing shoe according to the invention, the laminate is perforated in such a way that the opening or openings in the laminate are aligned with the steam outlet opening or openings in the sole plate of the iron.

In an embodiment of the ironing shoe according to the invention, the heat insulating layer comprises a rib around the laminate opening to reduce the risk of leakage of steam during use. In a practical embodiment, each individual laminate opening is surrounded by such a rib. The polymer material of the rib provides a sealing between the sole plate surface of the iron and the sole contact surface of the heat insulating layer. This sealing prevents steam leakage between the sole plate surface of the iron and the sole contact surface of the ironing shoe. This way, the steam is efficiently directed towards the garment. Preferably, the heat insulating layer and the rib are made from the same material selected from the group comprising silicone rubber, polyether ether ketone, polyimide, polyphenylene sulfide or polyamide-imide.

The steam from the iron of the boiler ironing system is usually expelled at a pressure higher than 1 bar. Leakage of steam from a pressurized ironing system results in steam under pressure. This may result in a higher risk for the user to burn his/her hand in the undesirable event of leakage. In an embodiment of an ironing shoe according to the invention, the shoe is provided with an edge rib located along the laminate periphery of the shoe. After mounting the shoe to the iron, the edge rib prevents ejected steam from moving upward; during use, this would be in the direction of the user's hand. The edge rib thus prevents the user burning his/her hand on leaking steam during use. This is especially useful for use of the ironing shoe in combination with the boiler ironing system. Preferably, the heat insulating layer and the edge rib are made from the same material selected from the group comprising silicone rubber, polyether ether ketone, polyimide, polyphenylene sulfide or polyamide-imide.

A suitable temperature drop between the iron sole plate and the garment contact surface, caused by the ironing shoe according to the invention, is in a range of 35 to 95° C.

A temperature drop of about 40° C. corresponds to the temperature difference between the temperatures of the 1-dot and 2-dot temperature setting of the iron, i.e. on average 110° C. and 150° C., respectively. During operation of the steam ironing device, the 2-dot temperature setting prevents the risk of spitting or dripping of water. An embodiment of the ironing shoe according to the invention results in a temperature drop of about 40° C. This embodiment is also referred to as a 2-dot ironing shoe. Mounting the 2-dot ironing shoe to the steam iron device would allow the user to steam iron a piece of delicate garment using a 2-dot temperature setting, while the temperature of the garment contact surface is about 110° C.

A temperature drop of about 90° C. corresponds to the difference between the average temperatures of the 1-dot and 3-dot temperature settings of the iron, i.e., respectively, 110° C. and 200° C. During operation of the steam ironing device, the 3-dot temperature setting prevents the risk of spitting or dripping of water.

An embodiment of the ironing shoe according to the invention results in a temperature drop of about 90° C. This embodiment is also referred to as a 3-dot ironing shoe. Mounting the 3-dot ironing shoe to the steam iron device would allow the user to steam iron a piece of delicate garment using a 3-dot temperature setting, while the temperature of the garment contact surface is about 110° C. A benefit of using a 3-dot temperature setting is that it allows the user to use the iron at its highest steam rate; this improves the ease of ironing.

The temperature drop can be influenced by the choice of material for the heat-insulating layer in combination with the thickness of this layer. The insulating layer may comprise a filler. The type of filler and the amount of filler may further influence the temperature drop. Usually the thickness of the heat insulating layer will be in a range of 0.2 to 4.0 mm.

It may be undesirable that a user uses the 2-dot ironing shoe in combination with the 3-dot temperature setting, because this would result in a garment contact surface temperature of about 160° C., which is likely to damage the delicate fabric.

In order to warn the user, the garment contact surface may be printed with a heat sensitive pigment that changes color if, for instance, the temperature of the garment contact surface is higher than about 110° C. A painted decoration comprising a heat sensitive pigment or dye, also referred to as thermochromic pigment or dye, may be applied to the garment contact surface of the 2-dot shoe. Such a thermochromic decoration may be applied in such a way that a warning becomes visible if the temperature of the garment contact surface is higher than about 110° C. An example of such a warning may be the text "TOO HOT for delicate fabrics" or a warning picture or a warning symbol. This way the user can be warned that the garment contact surface is too hot for delicate fabrics.

Thermochromism is the ability of a substance to change color due to a change in temperature at a predetermined temperature. The two basic approaches are based on liquid crystals and leuco dyes. An alternative may be zinc oxide. Zinc oxide is white at room temperature, but when it is heated its color changes to yellow due to various types of crystal lattice defects. On cooling the zinc oxide reverts to white. Lead (II) oxide has a similar color change on heating. These solids are technically semiconductors, and the color change is linked to their electronic properties. Copper mercury iodide undergoes a phase transition at 55° C., reversibly changing from a solid material at low temperature to a dark brown solid at high temperature. Yet another example is nickel sulfate, green at room temperature but turning yellow at 155° C.

The thermochromic pigment may be mixed with a thermostable plastic which is transparent or semitransparent, for instance mixed with PTFE and applied onto the heat transfer layer.

It may further be undesirable for the user to combine the 3-dot ironing shoe with the 2-dot temperature setting; this would result in a garment contact surface of about 60° C. This temperature may be too low to obtain a satisfying ironing result, despite the steaming action. If the temperature of the garment contact surface is too low, water evaporation from the garment is slow and a good ironing result will take some time. A garment contact temperature of at least 100° C. is therefore recommended.

A thermochromic decoration may be applied onto the garment contact surface of the 3-dot shoe, indicating the temperature of this surface is below 100° C. This is to warn the user that the temperature of the garment contact surface is too low for a satisfying ironing result. The decoration may be applied in such a way that an indication appears, such as the letters "TOO COLD" or a warning picture or symbol.

In an embodiment of the ironing shoe according to the invention, the heat-insulating layer comprises the thermochromic decoration on the garment contact surface. During use, the thermochromic decoration may indicate whether the temperature of the garment contact surface is similar to the 1-dot temperature setting, substantially higher than the 1-dot temperature setting or substantially lower than the 1-dot temperature setting. In this case, the predetermined temperature corresponds to the 1-dot temperature setting.

The invention also relates to a garment care system. The garment care system according to the invention comprises a steam ironing device comprising a steam generating means and an iron having a sole plate comprising at least one steam outlet opening, the sole plate having a sole plate surface, and the ironing shoe according to the invention.

A garment care system according to the invention may comprise the steam ironing device and two ironing shoes according to the invention: the 2-dot ironing shoe and the 3-dot ironing shoe. This allows the user to select the 2-dot or the 3-dot temperature setting of the steam ironing device and mount the corresponding ironing shoe, i.e., respectively, the 2-dot or the 3-dot ironing shoe. This would increase the flexibility for the user of the garment care system.

The invention further relates to a method of manufacturing an ironing shoe comprising the following steps:

- providing a heat insulating layer having a sole contact surface for making contact with a sole plate surface of an iron,
- providing a heat transfer layer having a garment contact surface for ironing,
- adhering the heat insulating layer and the heat transfer layer to each other, thereby forming a laminate, and
- creating at least one laminate opening in the laminate.

The heat insulating layer, i.e. a polymer sheet, may be applied onto the heat transfer layer, i.e. a metal sheet, in different ways. A few examples are listed below:

- via moulding, e.g. injection moulding, transfer moulding
- via spray coating of a solution in which the selected polymer is dissolved or
- via bonding the polymer sheet to the metal layer by means of an adhesive.

The method according to the invention may further comprise the step of: providing fastening means, wherein the fastening means and the heat insulating layer are made from the same material selected from the group comprising silicone rubber, polyether ether ketone, polyimide, polyphenylene sulfide or polyamide-imide.

The heat insulating layer and the fastening means may be made by the same forming process, such as in a single moulding step, for instance a single injection moulding step. Such a method reduces the number of process steps as compared to producing the heat insulating layer and the fastening means in separate steps and assembling them afterwards. By using the same material for the heat insulating layer and the fastening means, the number of different materials used is limited.

In an additional step, the thermochromic decoration may be applied. Printing techniques known by the skilled person may be used for this purpose.

The method according to the invention may further comprise the step of:

- providing a rib around the laminate opening to reduce the risk of leakage of steam during use, wherein the heat insulating layer, the fastening means and the rib are made in a single moulding step.

Preferably, the heat insulating layer and the rib are made from the same material selected from the group comprising silicone rubber, polyether ether ketone, polyimide, polyphenylene sulfide or polyamide-imide. By using the same material for the heat insulating layer and the rib or ribs the number of different materials used is limited.

The method according to the invention may further comprise the step of:

- providing an edge rib along at least a part of the laminate periphery P to reduce the risk of leakage of steam during use, wherein the heat insulating layer, the fastening means and the edge rib are made in a single moulding step.

Preferably, the heat insulating layer and the edge rib are made from the same material selected from the group comprising silicone rubber, polyether ether ketone, polyimide, polyphenylene sulfide or polyamide-imide.

In a further embodiment of the method according to the invention, the heat insulating layer, the fastening means, the rib and the edge rib may be made by the same forming process, such as in a single moulding step, for instance a single injection moulding step. Such a method reduces the number of process steps as compared to producing the heat insulating layer, the fastening means, the rib and the edge rib in separate steps and assembling them afterwards. Preferably, the heat insulating layer, the fastening means, the rib and the edge rib are made from the same material selected from the group comprising silicone rubber, polyether ether ketone, polyimide, polyphenylene sulfide or polyamide-imide. This way, the number of different materials used is reduced.

The invention also comprises any possible combination of features or subject matter as claimed in any one of the claims.

The invention will now be described, by way of example, with reference to the accompanying drawings, of which in principle different aspects can be combined.

In the drawings:

FIG. 1*a* schematically depicts a first embodiment of the ironing shoe according to the invention.

Figure 1B:
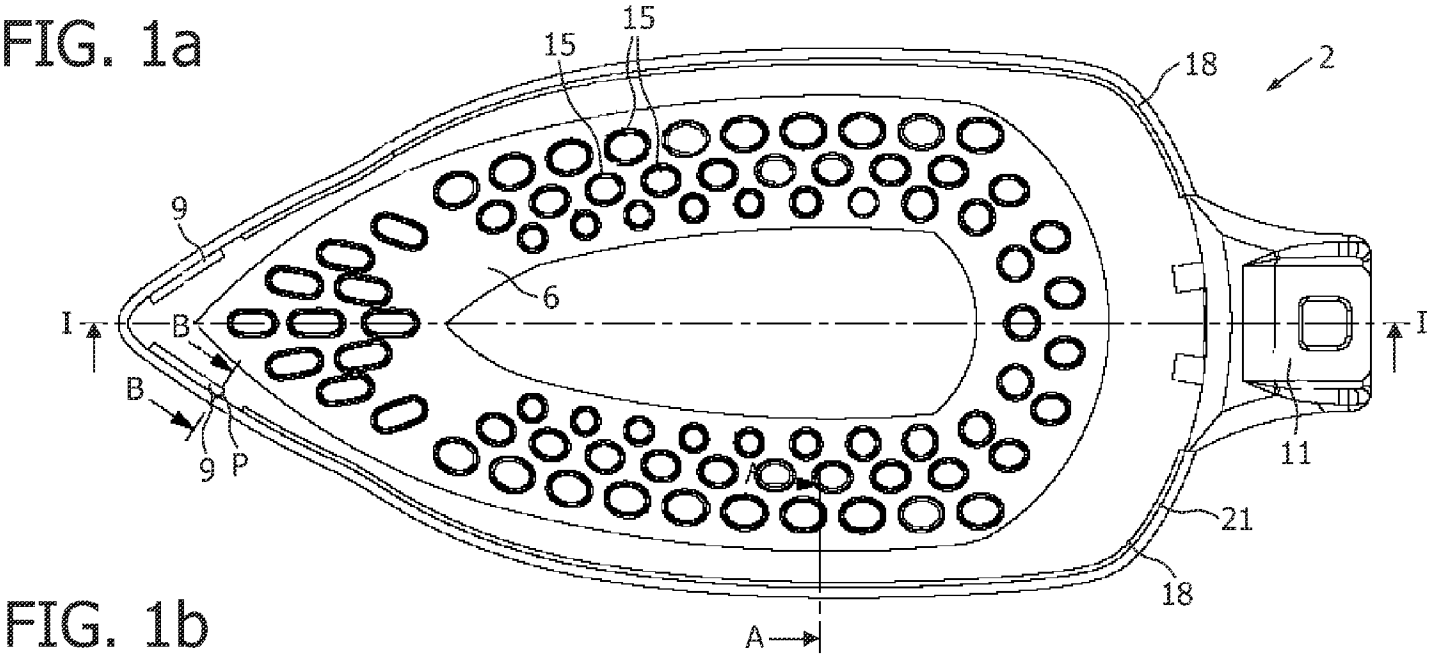

FIG. 1*b* schematically depicts a cross section along the line I-I in FIG. 1*a*.

Figure 1C:
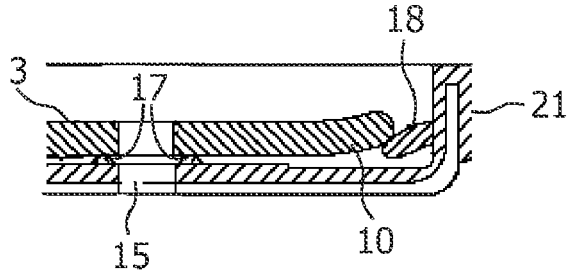

FIG. 1*c* schematically depicts an enlarged cross section along the line A-A in FIG. 1*a*.

Figure 1D:
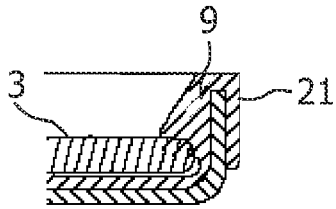

FIG. 1*d* schematically depicts an enlarged cross section along the line B-B in FIG. 1*a*.

Figure 2:
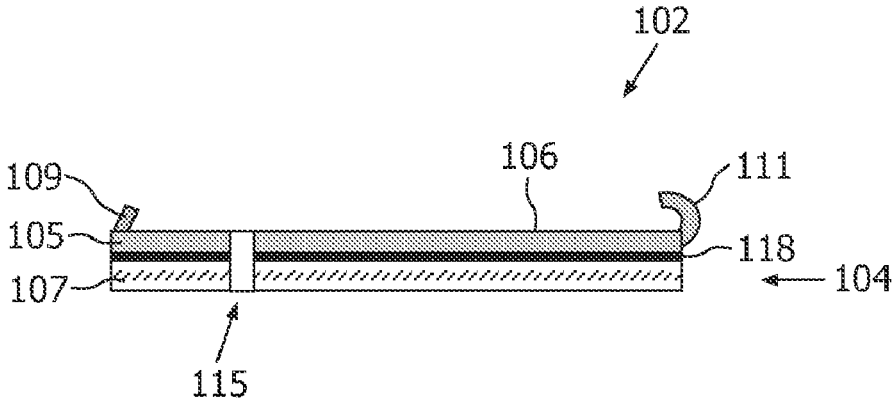

FIG. 2 schematically depicts a second embodiment of the ironing shoe according to the invention.

Figure 3:
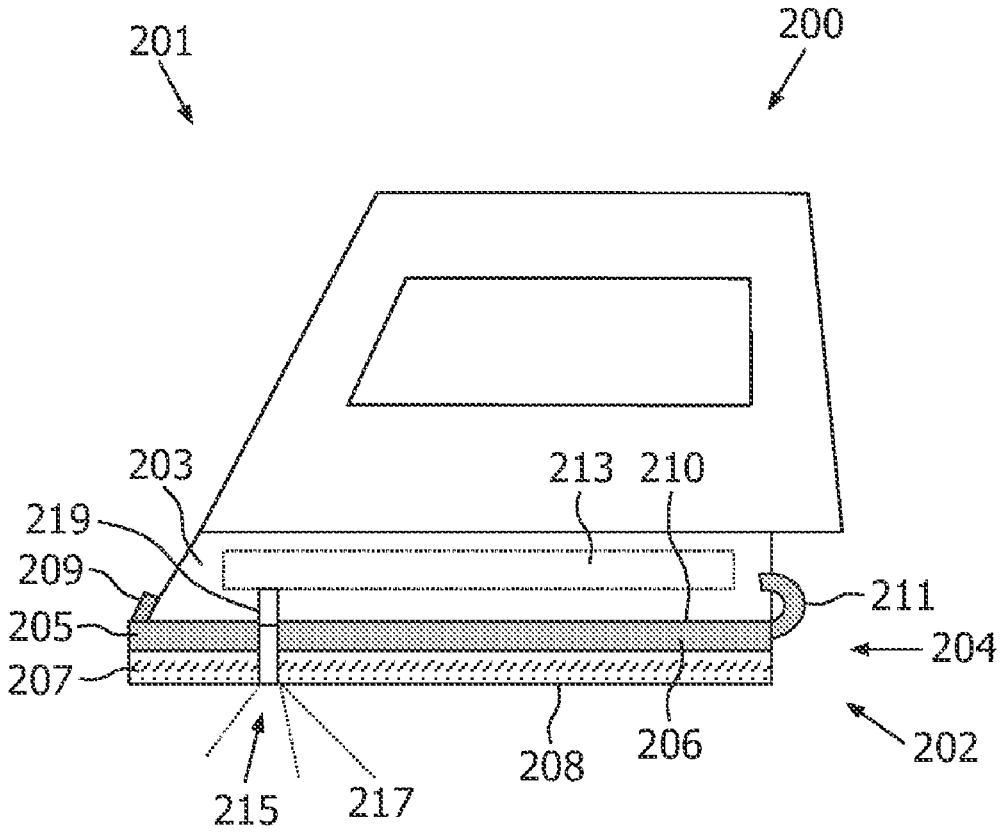

FIG. 3 schematically depicts a first embodiment of the garment care system according to the invention.

Figure 4:
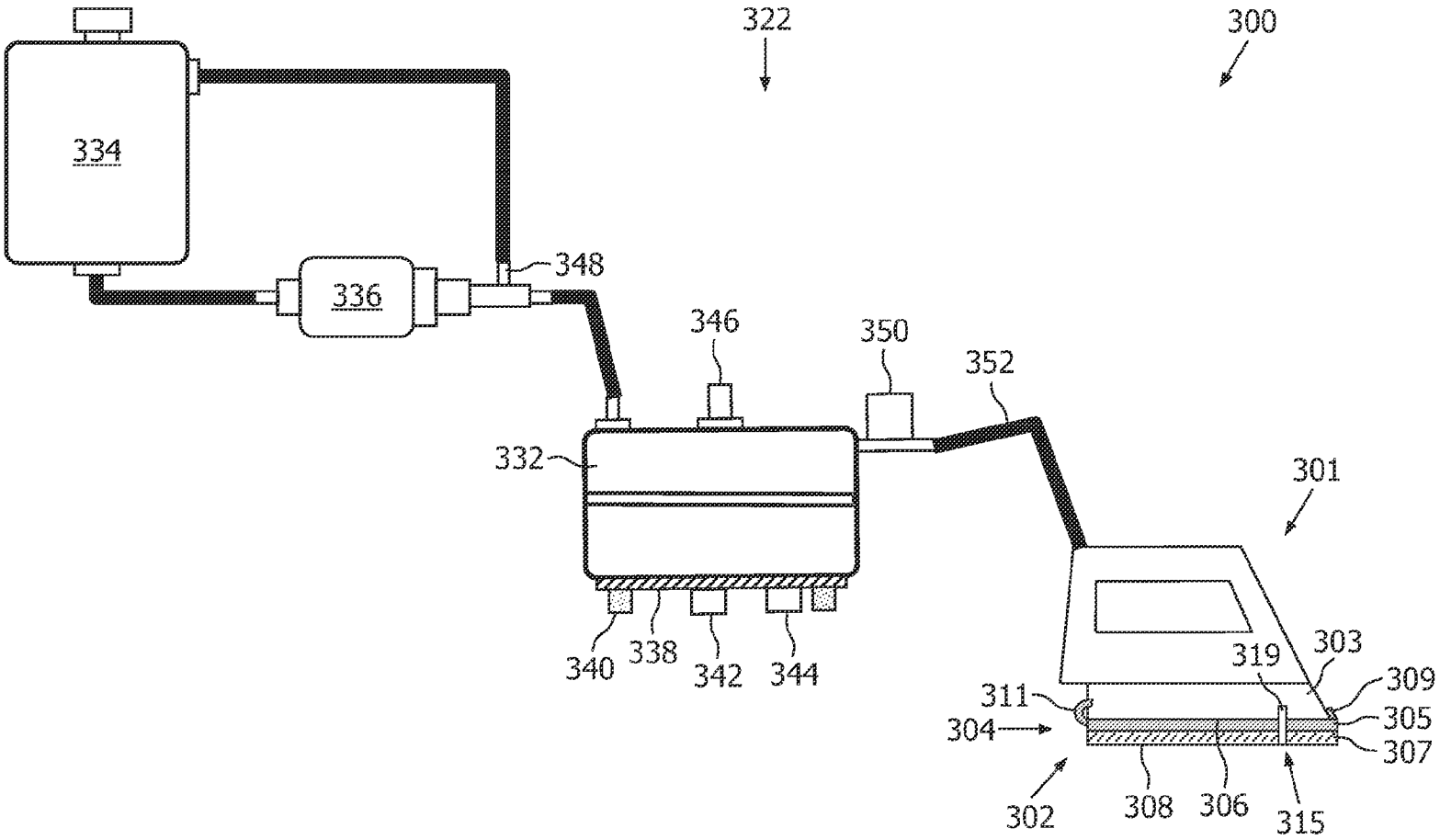

FIG. 4 schematically depicts a second embodiment of the garment care system according to the invention.

FIG. 5*a* schematically depicts a first embodiment of the garment contact surface of the 3-dot ironing shoe according to the invention comprising a thermochromic decoration.

FIG. 5*b* schematically depicts a "too cold" situation of a second embodiment of the garment contact surface of the 3-dot ironing shoe according to the invention comprising two thermochromic decorations.

FIG. 5*c* schematically depicts a "temperature OK" situation of the second embodiment of the garment contact surface of the 3-dot ironing shoe according to the invention comprising two thermochromic decorations.

FIGS. 5*d* and 5*e* schematically depict, respectively, the first and the second embodiment of a "too hot" situation of the garment contact surface of the 2-dot ironing shoe according to the invention comprising the thermochromic decoration.

In FIGS. 1*a* to 1*d* the first embodiment of the ironing shoe 2 according to the invention is depicted.

FIG. 1*b* is a cross sectional view along the line I-I in FIG. 1*a*. The ironing shoe comprises a laminate 4 having laminate openings 15. The laminate comprises a heat insulating layer 5 having a sole contact surface 6 and a heat transfer layer 7 having a garment contact surface 8 for ironing. The laminate periphery (P) of the laminate 4 is similar to a sole periphery of a sole plate of an iron (not shown). The shoe 2 is provided with fastening means comprising a protrusion 11 and two flank portions 9.

The flank portion 9 projects substantially perpendicularly to the heat insulating layer 5, the arrangement being such that, after mounting, the heat insulating layer 5 is in contact with the sole plate surface of the iron (not shown). Along at least a part of the periphery P, an edge rib 18 is attached to a raised border 21. In the first embodiment, shown in FIGS. 1*a*-1*d*, the edge rib is interrupted at the location of the fastening means comprising the protrusion 11 and two flank portions 9.

In FIG. 1*c*, an enlarged cross section along the line A-A in FIG. 1*a* is depicted. The laminate opening 15 is surrounded by a sealing rib 17. The sealing rib 17 is in contact with the sole plate surface 10 of the sole plate 3 of the iron (not shown). In a practical embodiment each laminate opening 15 is surrounded by a sealing rib 17. This way, leakage of steam is substantially reduced or prevented during use. The sealing properties of the ironing shoe 2 may be increased by the edge rib 18. The edge rib 18 is in contact with the surface 10 of the sole plate 3 and extends substantially along at least a part of the periphery P of the sole plate, thereby further sealing the sole plate of the iron and increasing the sealing properties of the ironing shoe 2. This is especially beneficial when used together with the iron of the boiler ironing system, wherein steam is usually expelled at a pressure higher than 1 bar.

FIG. 1*d* schematically shows an enlarged cross section along the line B-B in FIG. 1*a*. The ironing shoe 2 comprises two flank portions 9 attached to the raised border 21. The flank portions 9 together with the protrusion 11 prevent the shoe 2 from disengaging from the sole plate of the iron during use.

In FIG. 2, a cross sectional view of a second embodiment of the ironing shoe 102 according to the invention is schematically shown. The laminate 104 comprises the heat insulating layer 105, the heat transfer layer 107 and the adhesion layer 118 being present between the heat insulating layer and the heat transfer layer. The laminate 104 comprises the opening 115 for passing steam from the steam generating device, typically the steam iron (not shown). The flank portion 109 is located at the periphery and arranged for receiving part of the sole plate of the iron (not shown).

In FIG. 3, a first embodiment of the garment care system 200 according to the invention is depicted. The garment care system 200 in this embodiment comprises the steam iron 201 and the ironing shoe 202. In this embodiment, the steam ironing device comprises the steam iron 201. The steam iron 201 comprises a soleplate 203 having a soleplate surface 210. The steam generating means comprise a steam chamber 213 and a water reservoir (not shown).

The ironing shoe 202 according to the invention is mounted to the iron 201, the sole contact surface 206 of the heat insulating layer 205 is in contact with the sole plate surface 210 of the iron. The sole contact surface 206 and the garment contact surface 208 of the heat transfer layer 207 are turned away from each other. The sole plate 203 of the iron comprises a steam outlet opening 219. The laminate 204 is perforated in such a way that the opening 215 or openings in the laminate are aligned with the steam outlet opening 219 or openings in the sole plate 203 of the iron 201.

The steam chamber 213 is schematically shown. The steam from the steam chamber 213 reaches steam outlet opening 219 or openings provided in the sole plate 203 of the iron and travels through the opening 215. The steam leaving the opening 215 is depicted at 217. The heat insulation layer 205 may comprise a silicone rubber layer functioning as heat insulation and steam sealing layer.

The soft, non-brittle surface of the polymer layer is in contact with the sole plate 203, in particular the sole plate surface, during engagement and disengagement of the shoe 202. The polymer layer protects the sole plate surface 210 from scratches and damage. The shoe 202 is provided with fastening means comprising a protrusion 211 and a flank portion 209.

In FIG. 4, a second embodiment of the garment care system 300 according to the invention is depicted.

The steam ironing device in this embodiment is the so-called boiler ironing system: in such a system the steam generating means 322 comprise a boiler 332 for heating water which is arranged separately from the steam iron 301 and a water tank 334. The boiler 332 comprises a heating plate 338 connected to a heating element 340. An electrovalve 350 is arranged to open to allow steam to be released via the steam delivery hose 352 to the iron 301. The boiler usually further comprises a pressure sensor 342 to measure the pressure inside the boiler, a water level sensor 344 and a safety valve 346 that opens if the pressure inside the boiler 332 is too high. To fill the boiler, water is pumped from the water tank 334 to the boiler 332 by a water pump 336. A de-airing valve 348 may be present to let air escape from the water.

The garment care system 300 further comprises the iron 301 and an ironing shoe 302 according to the invention. The ironing shoe 302 is shown mounted to the iron 301, the sole contact surface 306 of the heat insulating layer 305 is in contact with the sole plate 303 of the iron. The sole contact surface 306 and the garment contact surface 308 of the heat transfer layer 307 are turned away from each other. The sole plate of the iron comprises a steam outlet opening 319. The laminate 304 is perforated in such a way that the opening 315 or openings in the laminate are aligned with the steam outlet opening 319 or openings in the sole plate 303 of the iron 301.

The shoe 302 is provided with fastening means comprising a protrusion 311 and a flank portion 309.

FIG. 5*a* schematically depicts the first embodiment of the garment contact surface 408 of the 3-dot ironing shoe according to the invention comprising a thermochromic print showing a visible warning pictogram 420. The thermochromic print comprises thermochromic pigment or a thermochromic dye selected such that it changes color at a predetermined temperature.

The "too cold" warning pictogram 420 serves to warn the user that the temperature of the garment contact surface 408 is below the 1-dot temperature setting. Such a warning pictogram would appear in the situation that the user has mounted the 3-dot ironing shoe to the iron and has heated the sole plate surface to the 2-dot temperature setting. In a practical embodiment, the thermochromic print changes color at a temperature of approximately 60° C. or higher. The color change may for instance be from colorless to red as the temperature of the garment contact surface 408 reaches or exceeds 60° C. In a practical embodiment, the thermochromic print is surrounded by a background print, which has the same color as the thermochromic print at elevated temperature, in this case above 60° C. At a temperature below 60° C., the pictogram 420 is then visible as a colorless image in a red background, a dia-negative image.

At 60° C. or higher, the thermochromic print changes color to red and due to the same color background, the pictogram 420 becomes illegible.

If the temperature of the garment contact surface 408 is 60° C. or higher, the thermochromic print is red, resulting in a red pictogram on a red background: due to a lack of color contrast the warning pictogram is illegible at the 1-dot temperature of the garment contact surface 408.

FIG. 5*b* schematically depicts a "too cold" situation of a second embodiment of the garment contact surface 408 of the 3-dot ironing shoe according to the invention comprising a visible alternative "too cold" warning pictogram 422 and an invisible pictogram 424 (shown in grey). Such a warning pictogram 422 would appear in the situation that the user has mounted the 3-dot ironing shoe to the iron and has heated the sole plate to the 2-dot temperature setting.

FIG. 5*c* schematically depicts a "temperature OK" situation of the second embodiment of the garment contact surface 408 of the 3-dot ironing shoe according to the invention comprising an invisible or illegible warning pictogram 422 (shown in grey) and a visible or legible "temperature OK" pictogram 424. This message would appear in the situation that the user has mounted the 3-dot ironing shoe to the iron and has heated the sole plate to the 3-dot temperature setting. It tells the user that the surface 408 is at the 1-dot temperature setting.

FIGS. 5*d* and 5*e* schematically depict, respectively, a first and second embodiment of the garment contact surface 408 of the 2-dot ironing shoe according to the invention comprising a visible "too hot" warning pictogram 426, 428. The warning pictogram 426, 428 serves to warn the user that the surface 408 is above the 1-dot temperature setting. Such a warning pictogram would appear in the situation that the user has mounted the 2-dot ironing shoe to the iron and has heated the sole plate to the 3-dot temperature setting. The pigment or dye in the thermochromic print is selected such that it changes color at a temperature of about 160° C. or higher, resulting in a legible warning pictogram 426, 428 when the temperature of the surface 408 is too high.

The 2-dot-ironing shoe may further comprise the thermochromic "temperature OK" pictogram print 424 shown in FIG. 5*c*.

The skilled person knows how to select a suitable thermochromic material and a suitable pictogram, warning text, etcetera.

To illustrate the effect of selecting a certain material for a heat insulating layer in the laminate and the thickness of the layer, the following examples are given:

EXAMPLE 1

A solution of 10-20 wt % SilRes® 610 (from Wacker) in di-isobutyl ketone was prepared.

Laminate A was made by spray coating the SilRes® 610 solution on an aluminum layer having a thickness of 0.8 mm. The polymer layer obtained had a thickness of about 2.0 mm. The temperature drop over laminate A thus obtained has been measured to be approximately 40° C.

EXAMPLE 2

An aluminum layer having a thickness of 0.8 mm was treated with an adhesive marketed as Dow Corning® S 2260 Prime coat.

Laminate B was made by injection moulding Elastosil® R401 (from Wacker) on the treated side of the aluminium layer. The polymer layer obtained had a thickness of about 2.0 mm. The temperature drop over laminate B thus obtained has been measured to be approximately 40° C.

EXAMPLE 3

Laminate C was prepared as follows:

A layer composed of (?) polyimide foil (Kapton® from DuPont) having a thickness of 0.3 mm was attached to an aluminum layer having a thickness of 0.8 mm using Epoxy Adhesive DP-125 from 3M adhesive. The temperature drop over the laminate C has been measured to be approximately 57° C.

What is claimed is:

1. An ironing shoe (2, 102, 202, 302) comprising a laminate (4, 104, 204, 304) having at least one laminate opening (15, 115, 215, 315) and a laminate periphery (P) corresponding to a sole periphery of a sole plate (3, 203, 303) of an iron (201, 301), the sole plate having a sole plate surface (10, 210), the laminate comprising a heat insulating layer (5, 105, 205, 305) having a sole contact surface (6, 106, 206, 306) for making contact with the sole plate surface of the iron and a heat transfer layer (7, 107, 207, 307) having a garment contact surface (8, 108, 208, 308, 408) for ironing, wherein the ironing shoe comprises a fastening means (9, 11, 109, 111, 209, 211, 309, 311) for fastening the shoe to the sole plate (203, 303) of the iron (201, 301), the fastening means (9, 11, 109, 111, 209, 211, 309, 311) comprises a protrusion (11, 111, 211, 311) being integrated with the heat insulating layer (5, 105, 205, 305), and the heat insulating layer (5, 105, 205, 305) and the protrusion (11, 111, 211, 311) are made from the same material.

2. An ironing shoe (2, 102, 202, 302) as claimed in claim 1, characterised in that the heat transfer layer (7, 107, 207, 307) is a reinforcement layer.

3. An ironing shoe (2, 102, 202, 302) as claimed in claim 1, characterised in that the material of the heat transfer layer (7, 107, 207, 307) comprises aluminum.

4. An ironing shoe (2, 102, 202, 302) as claimed in claim 1, characterised in that the heat insulating layer (5, 105, 205, 305) comprises a material selected from a group comprising silicone rubber, polyether ether ketone, polyimide, polyphenylene sulfide or polyamide-imide.

5. An ironing shoe (2, 102, 202, 302) as claimed in claim 1, characterised in that an adhesion layer (118) is present between the heat insulating layer (5, 105, 205, 305) and the heat transfer layer (7, 107, 207, 307).

6. An ironing shoe (2, 102, 202, 302) as claimed in claim 1, characterised in that the heat insulating layer (5, 105, 205, 305) comprises a rib (17) around the laminate opening (15, 115, 215, 315) to reduce the risk of leakage of steam during use.

7. An ironing shoe (2, 102, 202, 302) as claimed in claim 6, characterised in that the heat insulating layer (5, 105, 205, 305) and the rib (17) are made from the same material selected from the group comprising silicone rubber, polyether ether ketone, polyimide, polyphenylene sulfide or polyamide-imide.

8. An ironing shoe (2, 102, 202, 302) as claimed in claim 1, characterised in that the garment contact surface (8, 108, 208, 308, 408) comprises a thermochromic decoration (420, 422, 424, 426, 428) for indicating whether the temperature of the garment contact surface is similar to a predetermined temperature setting, substantially higher than the predetermined temperature setting or substantially lower than the predetermined temperature setting.

9. A garment care system (200, 300) comprising a steam ironing device comprising a steam generating means (213, 322) and an iron (201, 301) having a sole plate (3, 203, 303) comprising at least one steam outlet opening (219, 319), the sole plate having a sole plate surface (10, 210) and an ironing shoe (2, 102, 202, 302) according to claim 1.

10. An ironing shoe (2, 102, 202, 302) comprising a laminate (4, 104, 204, 304) having at least one laminate opening (15, 115, 215, 315) and a laminate periphery (P) corresponding to a sole periphery of a sole plate (3, 203, 303) of an iron (201, 301), the sole plate having a sole plate surface (10, 210), the laminate comprising a heat insulating layer (5, 105, 205, 305) having a sole contact surface (6, 106, 206, 306) for making contact with the sole plate surface of the iron and a heat transfer layer (7, 107, 207, 307) having a garment contact surface (8, 108, 208, 308, 408) for ironing, wherein the heat insulating layer (5, 105, 205, 305) comprises an edge rib (18) along at least a part of the laminate periphery P to reduce the risk of leakage of steam during use.

11. An ironing shoe (2, 102, 202, 302) as claimed in claim 10, characterised in that the heat insulating layer (5, 105, 205, 305) and the edge rib (18) are made from the same material selected from the group comprising silicone rubber, polyether ether ketone, polyimide, polyphenylene sulfide or polyamide-imide.

12. A garment care system (200, 300) comprising a steam ironing device comprising a steam generating means (213, 322) and an iron (201, 301) having a sole plate (3, 203, 303) comprising at least one steam outlet opening (219, 319), the sole plate having a sole plate surface (10, 210) and an ironing shoe (2, 102, 202, 302) according to claim 10.

13. Method of manufacturing an ironing shoe (2, 102, 202, 302) comprising the following steps:

providing a heat insulating layer (5, 105, 205, 305) having a sole contact surface (6, 106, 206, 306) for making contact with a soleplate surface (10, 210) of an iron (201, 301), providing a heat transfer layer (7, 107, 207, 307) having a garment contact surface (8, 108, 208, 308, 408) for ironing, adhering the heat insulating layer (5, 105, 205, 305) and the heat transfer layer to one another, thereby forming a laminate (4, 104, 204, 304), providing a fastening means (9, 11, 109, 111, 209, 211, 309, 311) for fastening the shoe to the sole plate of the iron (201, 301), the fastening means (9, 11, 109, 111, 209, 211, 309, 311) comprising a protrusion (11, 111, 211, 311) being integrated with the heat insulating layer (5, 105, 205, 305), and the heat insulating layer (5, 105, 205, 305) and the protrusion (11, 111, 211, 311) being made from the same material, and creating at least one opening (15, 115, 215, 315) in the laminate.

14. Method of manufacturing an ironing shoe (2, 102, 202, 302) according to claim 13, characterised in that the method further comprises the step of:

providing a fastening means (9, 11, 109, 111, 209, 211, 309, 311), wherein the fastening means and the heat insulating layer (5, 105, 205, 305) are made from the same material selected from the group comprising silicone rubber, polyether ether ketone, polyimide, polyphenylene sulfide or polyamide-imide.

15. Method of manufacturing an ironing shoe (2, 102, 202, 302) according to claim 14, characterised in that the heat insulating layer (5, 105, 205, 305) and the fastening (9, 11, 109, 111, 209, 211, 309, 311) means are made in a single moulding step.

16. Method of manufacturing an ironing shoe (2, 102, 202, 302) according to claim 14, characterised in that the method further comprises the step of:

providing a rib (17) around the laminate opening (15, 115, 215, 315) to reduce the risk of leakage of steam during use, and wherein the heat insulating layer (5, 105, 205, 305), the fastening means (9, 11, 109, 111, 209, 211, 309, 311) and the rib (17) are made in a single moulding step.

17. Method of manufacturing an ironing shoe (2, 102, 202, 302) comprising the following steps:

providing a heat insulating layer (5, 105, 205, 305) having a sole contact surface (6, 106, 206, 306) for making contact with a soleplate surface (10, 210) of an iron (201, 301), providing a heat transfer layer (7, 107, 207, 307) having a garment contact surface (8, 108, 208, 308, 408) for ironing, adhering the heat insulating layer (5, 105, 205, 305) and the heat transfer layer to one another, thereby forming a laminate (4, 104, 204, 304), the heat insulating layer (5, 105, 205, 305) also comprising an edge rib (18) along at least a part of the laminate periphery P to reduce the risk of leakage of steam during use, and creating at least one opening (15, 115, 215, 315) in the laminate.

* * * * *